US006851196B1

(12) United States Patent
Fry Leever et al.

(10) Patent No.: US 6,851,196 B1
(45) Date of Patent: Feb. 8, 2005

(54) RULER FOR CUTTING SHEET MATERIAL

(76) Inventors: Pamela J. Fry Leever, 2142 Woodland Blvd., Fort Myers, FL (US) 33907; Phillip William Leever, III, 2142 Woodland Blvd., Fort Myers, FL (US) 33907

( * ) Notice: Subject to any disclaimer, the term of this patent is extended or adjusted under 35 U.S.C. 154(b) by 0 days.

(21) Appl. No.: 10/652,932

(22) Filed: Sep. 2, 2003

(51) Int. Cl.[7] ..... B26B 29/00

(52) U.S. Cl. ..... 30/468; 30/289; 33/483; 83/746; 83/821

(58) Field of Search ..... 30/293, 294; 83/455, 83/468, 821, 746; 33/483, 496, 465, 459, 452, 466, 471, 500, 497, 403

(56) References Cited

U.S. PATENT DOCUMENTS 4,232,805 A * 11/1980 Flick ..... 223/37
5,079,842 A * 1/1992 Ward ..... 30/289
5,404,778 A * 4/1995 Ward ..... 83/49
6,141,882 A * 11/2000 Syken ..... 33/471

* cited by examiner

*Primary Examiner*—Douglas D Watts

(57) ABSTRACT

A ruler that is to be used for cutting sheets of material perpendicular to its longitudinal edges. The ruler is a longitudinal piece of rigid material that increases in thickness from one edge to the other. A cutting groove is placed into the rigid material at a thickened edge so as to aid the direction of a sharpened instrument passing through the groove while cutting the material. A hardened insert may be inserted into the groove to prevent the edges of the groove being damaged by the sharp cutting instrument. One end of the ruler has an extension of eyelet molded thereon and the other end of the ruler has a depression molded into an under surface of the ruler. Both the eyelet and the depression have a matching configuration to snap-fit into each other to thereby connect two rulers together in a rigid manner.

4 Claims, 1 Drawing Sheet

RULER FOR CUTTING SHEET MATERIAL

BACKGROUND OF THE INVENTION

This invention relates to a ruler that can be used for cutting sheets. The cutting of sheets is not simple because it involves different applications. For example, sheets are cut from a large roll of wallpaper at a precise distance from the beginning and this cutting has to be precise because the cut should be square or normal to the long distance of the wallpaper.

Fabric stores sell fabrics by a certain length that is, by the yard. The fabric is pulled off a bolt of fabric, measured to a certain length and then cut across at right angles. Many times a plain ruler is used to aid as a straight edge and then a cut may be made. Since the fabric is supple, it is not always easy to keep the fabric straight when a cut is made. Many fabric stores have a large cutting table with a groove inserted into one end of the cutting table. A cutting tool such as scissors or a sharpened instrument like a razor is used to cut across the fabric into the groove as a guide to accomplish a straight cut.

A homeowner does not have available such a cutting table when undertaking the cutting of long sheets at a precise cut. Such a cutting would involve a home dressmaker, a home decorator when hanging wallpaper or when cutting certain lengths of paper for wrapping packages or Christmas gifts.

BRIEF SUMMARY OF THE INVENTION

In view of all of the above, it would be highly desirable to have a measuring instrument that can be used for many different purposes when cutting sheets of paper, wallpaper or fabrics. The instrument can be short in length or could be easily extensible to a different length by placing several lengths together in a snap-fit fashion. The instrument should be of such a cross section so that the incoming sheet can easily ride-up a shallow slope so that it will not obstruct a smooth movement of a sheet whether it is paper or fabric. There should be a cutting groove contained within the instrument to aid the operator in cutting a straight line whether this is done with scissors or a sharpened edge.

DETAILED DESCRIPTION OF THE INVENTION

Figure 1:
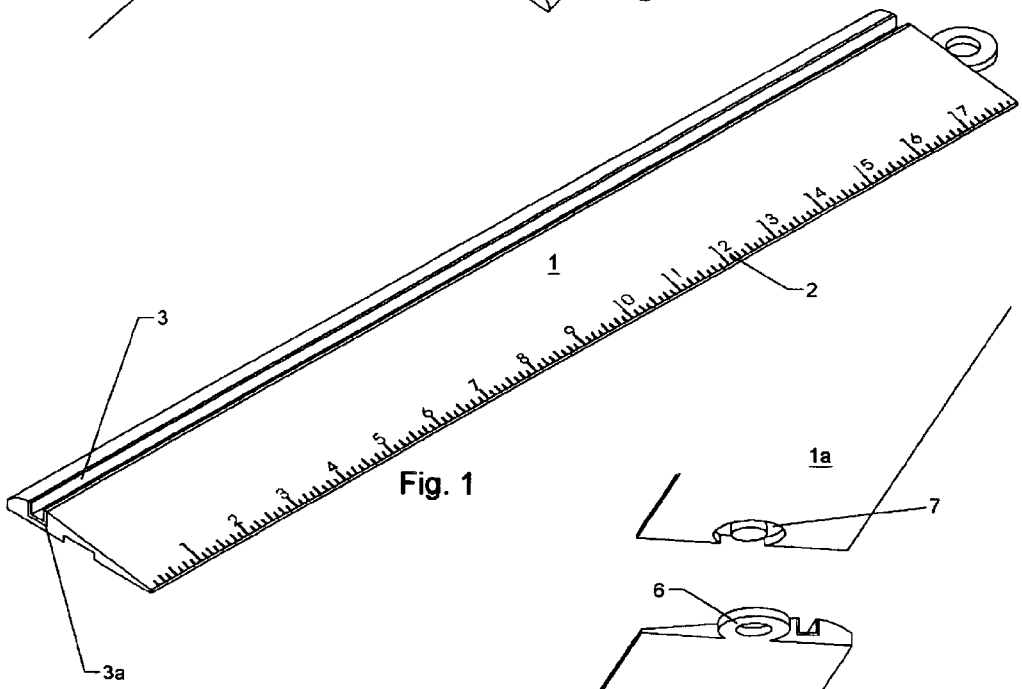
FIG. 1 illustrates the overall structure of the ruler

FIG. 1 illustrates the structure or the shape of the ruler. The ruler itself may be made of any kind of material such as wood, plastic, aluminum or stainless steel. The use of wood may distort the ruler because of warping. The use of plastic is preferred because this material will hold its shape. It may be preferred that some weight is added to the structure of the ruler which will add to the stability of the ruler. After all, in use, the ruler will be placed under the material to be cut and any weight will add to the ruler being held stationary during the cutting process. In FIG. 1, the basic ruler is shown at 1. To add to the versatility of the ruler it is preferred that a measuring scale 2 could be added. There is a cutting groove shown at 3 which is important in the use of the ruler. The cutting groove 3 is a guide for the cutting instrument to cut the superimposed sheet. This assures a precise cut perpendicular to the longitudinal edges of the sheet to be cut. The scissors or any sharpened blade has only to run in the groove when a cutting takes place.

FIG. 1 also includes an insert channel 3*a* which snugly fits into the groove 3. This insert channel 3*a* may be made of a hardened material such as aluminum to prevent the groove 3 from being damaged during the process of cutting. If the groove 3 is not protected in this manner, the sharp cutting instrument may deviate from its cutting path and may leave a cutting mark within the channel to thereby shorten the useful life of the ruler.

Figure 2:
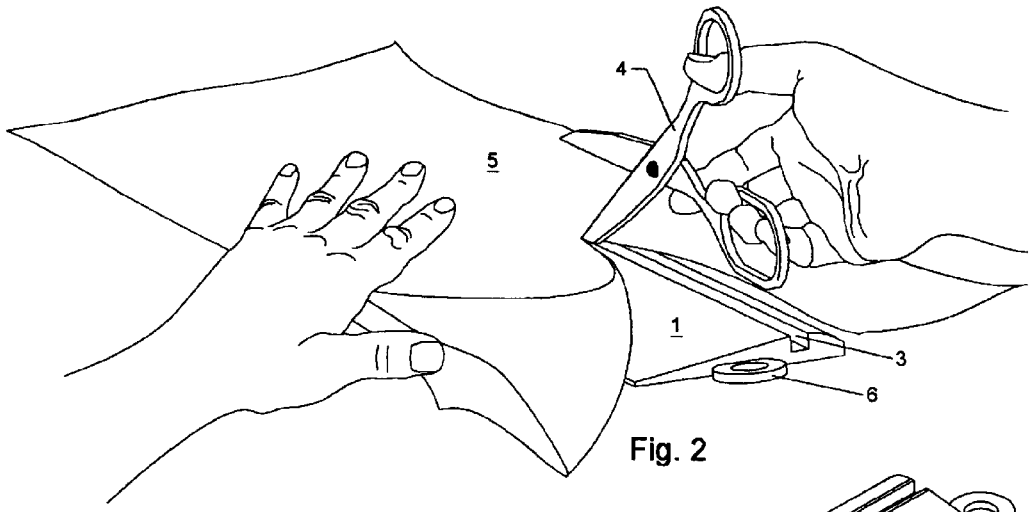
FIG. 2 shows the use of the ruler

FIG. 2 shows the cutting process with the ruler 1 included. As can be seen, the sheet 5 to be cut is placed over the ruler 1 and scissors 4 or any other sharp cutting tool is passed along the groove 3 to thereby cut the material. The cutting cannot deviate from its path because of the presence of the groove 3.

Figure 3:
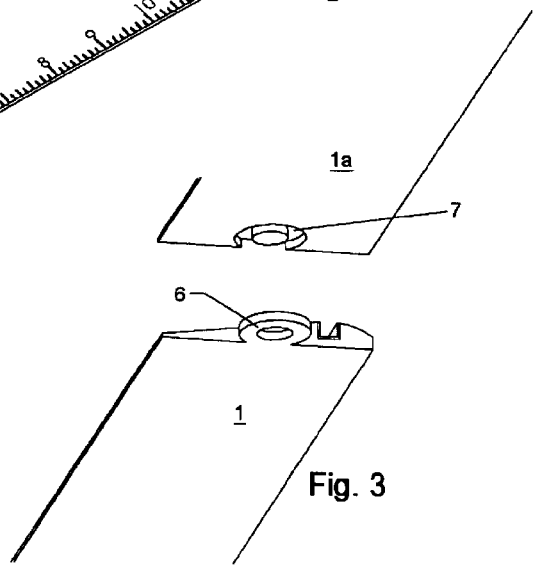
FIG. 3 shows how two or more rulers may be connected to each other

FIG. 3 illustrates a ruler 1 that may be extended or fastened to a second ruler. The ruler as described so far may be of a certain length such as 12" or 18". Many sheets of fabric are much wider than the above described lengths. To be able to be extended to different lengths, one end of the ruler 1 has an eyelet 6 molded or cut into the end of the ruler 1. The other end of the ruler has a depression 7, again, molded or cut into ruler 1. Both the eyelet 6 and the depression have the same configuration so that they can be inserted into each other. If the tolerances in dimension are kept very close, the eyelet 6 and the depression 7 can be snap-fitted into each other to create a sturdy and rigid connection.

From all three FIGS. 1–3 it can be seen that the ruler should have a certain cross sectional shape. The cross section should be such so that the incoming sheet 5 has no obstruction when pulled over the ruler, that is, very thin. The thickness of the ruler from the first thin area should slowly increase to a thickness so that the groove in the ruler can be accommodated. The thickness from there should come to an abrupt halt of end face.

What is claimed is:

1. A cutting guide, having two longitudinal edges, two ends and an upper and lower surface and adapted to aid in cutting a sheet of material, said guide consisting of rigid material, having a thin thickness at one of its longitudinal edges but increasing to a greater thickness at the other longitudinal edge, a cutting groove disposed longitudinally in the top of the thicker material, and a connecting device for immovably fastening plural guides together, said fastening device consisting of a an eyelet extending from an end of the guide and a depression at the other end of the guide in the bottom of the guide, said depression having a post therein which does not protrude from beyond the bottom surface of the guide, said post coupling with the eyelet of another guide to immovably couple them together.

2. The ruler of claim 1 including a hardened insert in said groove to prevent any edges of said groove from being damaged by a cutting instrument.

3. The ruler of claim 1, wherein said eyelet and said depression are of a matching configuration to snap-fit into each other.

4. The ruler of claim 1 including a measuring scale placed at one of the edges of said ruler.

* * * * *